US008896406B2

(12) United States Patent
Yamamoto

(10) Patent No.: US 8,896,406 B2
(45) Date of Patent: Nov. 25, 2014

(54) LAMINATED COIL

(75) Inventor: Satoshi Yamamoto, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 41 days.

(21) Appl. No.: 13/611,940

(22) Filed: Sep. 12, 2012

(65) Prior Publication Data

US 2013/0069754 A1 Mar. 21, 2013

(30) Foreign Application Priority Data

Sep. 16, 2011 (JP) ..... 2011-203083

(51) Int. Cl.

| | |
|---|---|
| ***H01F 27/30*** | (2006.01) |
| ***H01F 5/00*** | (2006.01) |
| ***H01F 27/28*** | (2006.01) |
| *H01F 27/32* | (2006.01) |

(52) U.S. Cl.

CPC ..... *H01F 5/00* (2013.01); *H01F 27/2847* (2013.01); *H01F 27/303* (2013.01); *H01F 27/323* (2013.01)

USPC ..... 336/207; 336/200; 336/232; 336/222

(58) Field of Classification Search

CPC . H01F 27/323; H01F 27/322; H01F 27/2847; H01F 27/306; H01F 41/04; H01F 27/2804; H01F 17/0013; H01F 5/003; H01F 41/046; H01F 41/041

USPC ..... 336/207, 200, 232, 222

See application file for complete search history.

(56) References Cited

U.S. PATENT DOCUMENTS

| | | | | |
|---|---|---|---|---|
| 3,543,194 | A * | 11/1970 | Kassabgi | 333/156 |
| 7,439,839 | B2 * | 10/2008 | Podlisk et al. | 336/200 |
| 8,013,709 | B2 * | 9/2011 | Tsai et al. | 336/208 |
| 8,179,222 | B2 * | 5/2012 | Lee et al. | 336/208 |
| 8,289,119 | B2 * | 10/2012 | Lin et al. | 336/192 |
| 2010/0026437 | A1 * | 2/2010 | Lin et al. | 336/192 |

FOREIGN PATENT DOCUMENTS

| | | |
|---|---|---|
| JP | 9-306757 A | 11/1997 |
| JP | 2010-010176 | 1/2010 |

* cited by examiner

*Primary Examiner* — Alexander Talpalatski
*Assistant Examiner* — Kazi Hossain
(74) *Attorney, Agent, or Firm* — Foley & Lardner LLP

(57) ABSTRACT

A laminated coil includes a plurality of circular conductive plates in the form of a flat plate, each of the circular conductive plates being laminated via an insulating material in an axis direction. The plurality of circular conductive plates each include a plurality of concentric circular arc parts having different inner diameter and outer diameter from each other, and a connection part interconnecting the plurality of circular arc parts. The plurality of circular conductive plates are arranged such that the connection parts thereof face each other and the circular arc parts thereof are juxtaposed to each other in a radial direction.

8 Claims, 8 Drawing Sheets

LAMINATED COIL

The present application is based on Japanese patent application No. 2011-203083 filed on Sep. 16, 2011, the entire contents of which are incorporated herein by reference.

BACKGROUND OF THE INVENTION

1. Field of the Invention

This invention relates to a laminated coil, in particular, this invention relates to a laminated coil configured to have a structure that a plurality of circular conductive plates are laminated in an axis direction.

2. Description of the Related Art

A coil is known that has a configuration obtained by winding plural rectangular wires in an axis direction (for example, refer to JP-A-H9-306757 and JP-A-2010-10176).

A short height-type laminated coil described in JP-A-H9-306757 has a configuration that a first coil and a second coil formed by winding rectangular wires in an axis direction, the coils having three turns respectively, are arranged so as to be formed in a concentric shape and be juxtaposed to each other.

A multiple coil described in JP-A-2010-10176 has a configuration that single-layer coils juxtaposed to each other by parallel and flatwise winding rectangular insulating wires in an axis direction are stacked into two or more tiers closely contacting with each other.

SUMMARY OF THE INVENTION

In the coils having the above-mentioned configuration, the whole length of the coil located interiorly is shorter than that of the coil located exteriorly, thus electrical resistance of the coil located interiorly becomes relatively lowered, and electrical current becomes concentrated at the coil located interiorly, so that heat generation due to Joule heat in the coil located interiorly becomes larger than that in the coil located exteriorly. In addition, the coil located interiorly is surrounded by the coil located exteriorly over the whole periphery thereof thus it has a lower radiation property than the coil located exteriorly, and consequently electrical current allowed to flow is limited due to increase in temperature of the coil located interiorly.

In addition, it is considered that the coil located interiorly is configured to have a width smaller than that of the coil located exteriorly, thereby electrical resistance (direct-current component) of the coil located interiorly is equalized with that of the coil located exteriorly, but even though the above-mentioned measure is taken, in case of allowing electrical current including high-frequency component to flow, the coil located exteriorly has an area surrounding the current pathway wider than that of the coil located interiorly, thus the coil located exteriorly has an inductance larger than that of the coil located interiorly, thereby current components of high frequency flow to the coil located interiorly in an amount more than to the coil located exteriorly. Consequently, heat generation of the coil located interiorly becomes larger than that of the coil located exteriorly after all.

Furthermore, the coils located interiorly and exteriorly are covered with an insulating material such as polyimide for insulating between the coils, and the insulating material has a thermal resistance higher than a conductive metal constituting the coils such as copper, aluminum. Accordingly, in case of allowing heat generated in the coil located interiorly to escape toward the direction of the outer periphery, an insulating material at the outer peripheral side of the coil located interiorly and insulating materials at the inner and outer peripheral sides of the coil located exteriorly are included in the radiation pathway, thus the radiation property of the coil located interiorly is further lowered.

Therefore, it is an object of the invention to provide a laminated coil that is improved in a radiation property in comparison with a case that an outer peripheral side of a circular conductive plate having a small diameter is surrounded by a circular conductive plate having a large diameter.

(1) According to one embodiment of the invention, a laminated coil comprises:

a plurality of circular conductive plates in the form of a flat plate, each of the circular conductive plates being laminated via an insulating material in an axis direction, wherein the plurality of circular conductive plates each comprise a plurality of concentric circular arc parts having different inner diameter and outer diameter from each other, and a connection part interconnecting the plurality of circular arc parts, and wherein the plurality of circular conductive plates are arranged such that the connection parts thereof face each other and the circular arc parts thereof are juxtaposed to each other in a radial direction.

In the above embodiment (1) of the invention, the following modifications and changes can be made.

(i) The connection part has a thickness less than the plurality of the circular arc parts.

(ii) The plurality of circular conductive plates comprise a first circular conductive plate and a second circular conductive plate, the first circular conductive plate and the second circular conductive plate each comprise a first circular arc part, a second circular arc part that is formed concentric with the first circular arc part and has an inner diameter more than an outer diameter of the first circular arc part, and the connection part interconnecting the first circular arc part and the second circular arc part, and the second circular arc part of the second circular conductive plate is arranged outside in the radial direction of the first circular arc part of the first circular conductive plate, and the second circular arc part of the first circular conductive plate is arranged outside in the radial direction of the first circular arc part of the second circular conductive plate.

(iii) The first circular conductive plate and the second circular conductive plate have a same shape, and are laminated such that the obverse side and the reverse side of one of the circular conductive plates are inverted.

(iv) The plurality of circular conductive plates comprise a first circular conductive plate, a second circular conductive plate, and a third circular conductive plate, the first to third circular conductive plates each comprise a first circular arc part, a second circular arc part that is formed concentric with the first circular arc part and has an inner diameter more than an outer diameter of the first circular arc part, a third circular arc part that is formed concentric with the first and second circular arc parts and has an inner diameter more than an outer diameter of the second circular arc part, and a first connection part and a second connection part that interconnect any two circular arc parts of the first to third circular arc parts, and the first to third circular conductive plates are laminated such that outside in the radial direction of the first circular arc part of any one of the first to third circular conductive plates, the second and third circular arc parts of the other two circular conductive plates are arranged.

(v) Any two circular conductive plates of the first to third circular conductive plates have a same shape, and the two circular conductive plates are laminated such that the obverse side and the reverse side of one of the circular conductive plates are inverted.

Points of the Invention

According to one embodiment of the invention, a laminated coil is constructed such that a first circular conductive plate and a second circular conductive plate are laminated with each other in a central axis line direction with each connection part of the first and second conductive plates facing each other. In addition, when the first and second circular conductive plates are laminated, a second circular arc part of the first plate is arranged outside in a radial direction of a first circular arc part of the second plate, and a second circular arc part of the second plate is arranged outside in the radial direction of a first circular arc part of the first plate. Here the first circular arc parts of the first and second plates arranged inside in the radial direction are surrounded by the second circular arc parts arranged outside in the radial direction, they have a radiation property lower than the second circular arc parts. However, heat generated in the first circular arc parts (inside) is conducted to the second circular arc parts (outside) and dissipated therefrom to the periphery, whereby it is possible to prevent heat from being confined in the first circular arc parts (inside). Thereby, the radiation property of the laminated coil can be enhanced.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First Embodiment

Figure 1A:
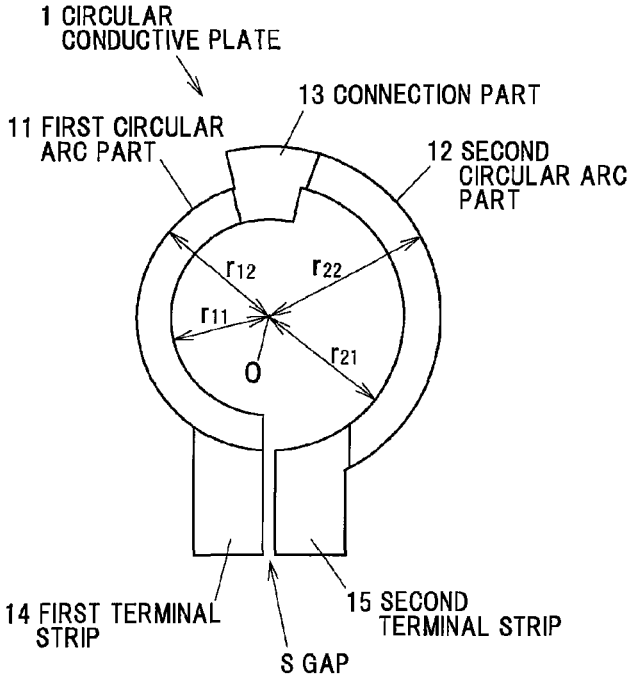
FIG. 1A is a front elevation view schematically showing an example of a configuration of a circular conductive plate constituting a laminated coil according to one embodiment of the invention.
Figure 1B:
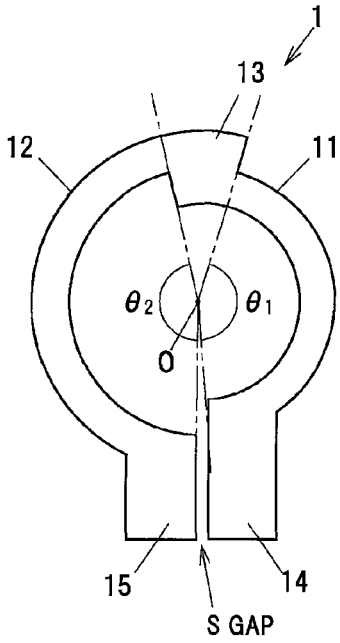
FIG. 1B is a back elevation view schematically showing a configuration of a circular conductive plate constituting a laminated coil according to an embodiment of the invention.

FIGS. 1A and 1B are a front elevation view and a back elevation view schematically showing an example of a configuration of a circular conductive plate constituting a laminated coil according to one embodiment of the invention respectively.

A circular conductive plate 1 is composed of a conductive metal such as copper, aluminum and is formed in a flat plate-like shape. The circular conductive plate 1 integrally includes a first circular arc part 11, a second circular arc part 12, a connection part 13 that interconnects the first circular arc part 11 and the second circular arc part 12, a first terminal strip 14 formed so as to be continuous with the first circular arc part 11, and a second terminal strip 15 formed so as to be continuous with the second circular arc part 12. In addition, the circular conductive plate 1 is formed in a circular shape except for a gap (S) having a slit-like shape formed between the first terminal strip 14 and the second terminal strip 15.

The first circular arc part 11 and the second circular arc part 12 have an arc-like shape and are formed in a concentric shape sharing a center point (O), and are formed so as not to be overlapped with each other in a radial direction. The first circular arc part 11 and the second circular arc part 12 are different from each other in an inner diameter and an outer diameter and the second circular arc part 12 is formed so as to have an inner diameter larger than an outer diameter of the first circular arc part 11. In the embodiment, they are configured to have a dimension that an internal radius (r11) of the first circular arc part 11 (a distance from the center point (O) to an inner end of the first circular arc part 11) is 14.5 mm, an external radius (r12) of the first circular arc part 11 (a distance from the center point (O) to an outer end of the first circular arc part 11) is 19.5 mm, an internal radius (r21) of the second circular arc part 12 (a distance from the center point (O) to an inner end of the second circular arc part 12) is 20.0 mm, and an external radius (r22) of the second circular arc part 12 (a distance from the center point (O) to an outer end of the second circular arc part 12) is 25 mm.

The connection part 13 has an arc-like shape of which width in a radius direction is formed wider than those of the first circular arc part 11 and the second circular arc part 12, and it is connected with one end of the first circular arc part 11 at its one end in a circumferential direction, and connected with one end of the second circular arc part 12 at its another end in a circumferential direction. The connection part 13 is formed so as to have a thickness thinner than the first circular arc part 11 and the second circular arc part 12.

The first terminal strip 14 is disposed at another end of the first circular arc part 11 (an end opposite to the end connected with the connection part 13). In addition, the second terminal strip 15 is disposed at another end of the second circular arc part 12 (an end opposite to the end connected with the connection part 13). The first terminal strip 14 and the second terminal strip 15 are juxtaposed to each other via the gap (S) having a slit-like shape, and are formed to have a rectangular shape that extends outward from the another ends of the first circular arc part 11 and the second circular arc part 12 in a radial direction. The first terminal strip 14 and the second terminal strip 15 are formed so as to have a thickness thinner than the first circular arc part 11 and the second circular arc part 12.

The connection part 13 is formed at a position bearing a point-symmetrical relationship based on the center point (O) to the gap (S) between the first terminal strip 14 and the second terminal strip 15. This makes it possible to have a configuration that an angle (θ1) from one end of the connection part 13 to the gap (S) via the first circular arc part 11 and an angle (θ2) from another end of the connection part 13 to the gap (S) via the second circular arc part 12 are approximately equalized.

On the back elevation view as shown in FIG. 1B, the first circular arc part 11, the second circular arc part 12, the connection part 13, the first terminal strip 14 and the second terminal strip 15 are formed so as to be juxtaposed to each other on the same plane. In addition, on the front elevation view as shown in FIG. 1A, the connection part 13, the first terminal strip 14 and the second terminal strip 15 are formed to become depressed than the first circular arc part 11 and the second circular arc part 12.

Figure 2A:
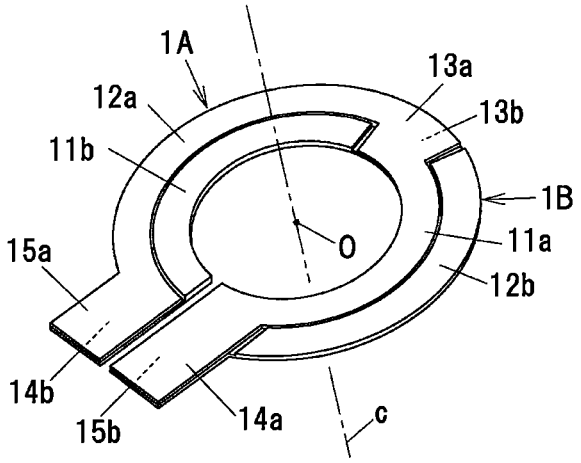
FIG. 2A is a perspective view schematically showing a state that two circular conductive plates are laminated in an axis direction such that the obverse side and the reverse side of any one of the circular conductive plates are inverted.
Figure 2B:
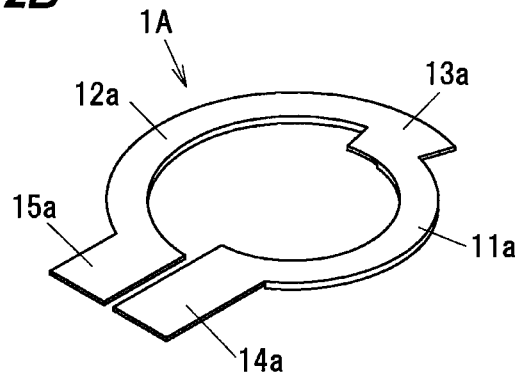
FIG. 2B is an exploded perspective view of FIG. 2A.
Figure 2C:
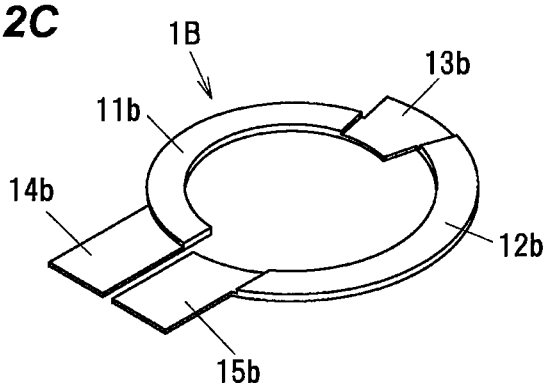
FIG. 2C is an exploded perspective view of FIG. 2A.

FIG. 2A is a perspective view schematically showing a state that two circular conductive plates are laminated in an axis direction such that the obverse side and the reverse side of any one of the circular conductive plates are inverted, FIGS. 2B and 2C are an exploded perspective view of FIG. 2.

Two circular conductive plates 1 have the same shape with each other, but in a subsequent explanation, for the purpose of differentiating the two circular conductive plates 1 from each other, one of the two circular conductive plates 1 is referred to as "first circular conductive plate 1A", and another of them is referred to as "second circular conductive plate 1B".

In addition, the first circular arc part 11 of the first circular conductive plate 1A is referred to as "first circular arc part 11*a*", the second circular arc part 12 thereof is referred to as "second circular arc part 12*a*", the connection part 13 thereof is referred to as "connection part 13*a*", the first terminal strip 14 thereof is referred to as "first terminal strip 14*a*" and the second terminal strip 15 thereof is referred to as "second terminal strip 15*a*".

In addition, similarly, the first circular arc part 11 of the second circular conductive plate 1B is referred to as "first circular arc part 11*b*", the second circular arc part 12 thereof is referred to as "second circular arc part 12*b*", the connection part 13 thereof is referred to as "connection part 13*b*", the first terminal strip 14 thereof is referred to as "first terminal strip 14*b*" and the second terminal strip 15 thereof is referred to as "second terminal strip 15*b*".

The first circular conductive plate 1A and the second circular conductive plate 1B are laminated with each other in a central axis line (c) direction (in an axis direction) such that the connection part 13*a* and the connection part 13*b* face each other. In addition, as shown in FIG. 2A, in a state that the first circular conductive plate 1A and the second circular conductive plate 1B are laminated, the second circular arc part 12*a* is arranged at an outer side in a radial direction of the first circular arc part 11*b*, and the second circular arc part 12*b* is arranged at an outer side in a radial direction of the first circular arc part 11*a*. Namely, the first circular conductive plate 1A and the second circular conductive plate 1B are arranged such that the first circular arc part 11*b* and the second circular arc part 12*a* are juxtaposed to each other in a radial direction, and the first circular arc part 11*a* and the second circular arc part 12*b* are also juxtaposed to each other in a radial direction.

Further, in the embodiment, the first circular conductive plate 1A and the second circular conductive plate 1B are laminated such that positions in an axis direction of the first circular arc part 11*b* and the second circular arc part 12*a*, and positions in an axis direction of the first circular arc part 11*a* and the second circular arc part 12*b* are reconciled with each other, namely the first circular arc part 11*a*, the second circular arc part 12*a*, the first circular arc part 11*b* and the second circular arc part 12*b* are arranged on the same plane perpendicular to the central axis line (c), but it is only necessary for the first circular arc part 11*b* and the second circular arc part 12*a*, and the first circular arc part 11*a* and the second circular arc part 12*b* to be juxtaposed to each other in a radial direction such that they are overlapped with each other at least partly in a thickness direction.

Figure 3A:
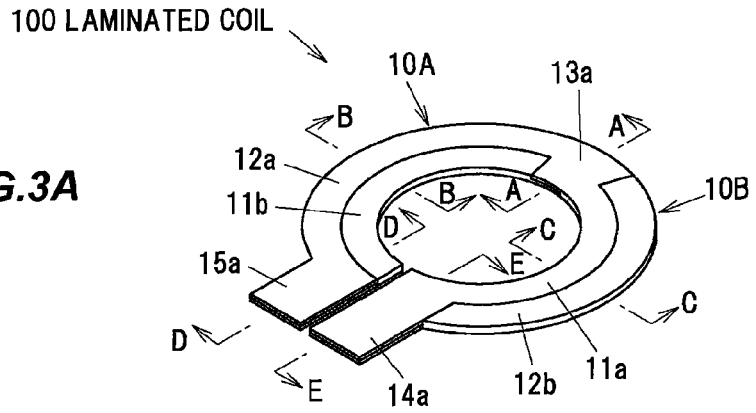
FIG. 3A is an overall perspective view schematically showing a laminated coil having a configuration that a first coil part and a second coil part are laminated in an axis direction.
Figure 3B:
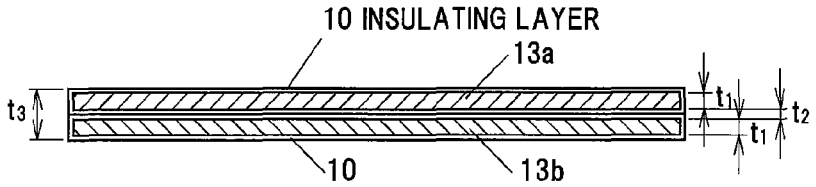
FIG. 3B is a cross-sectional view taken along the line A-A in FIG. 3A.
Figure 3C:
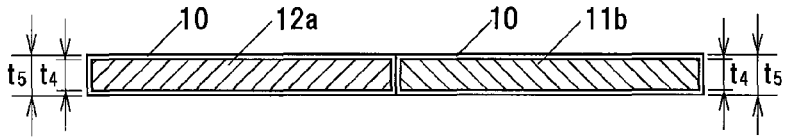
FIG. 3C is a cross-sectional view taken along the line B-B in FIG. 3A.
Figure 3D:
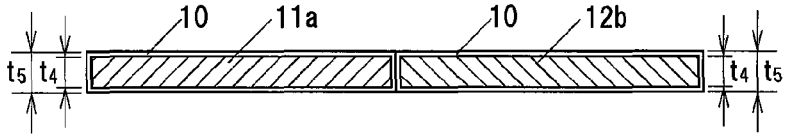
FIG. 3D is a cross-sectional view taken along the line C-C in FIG. 3A.
Figure 3E:
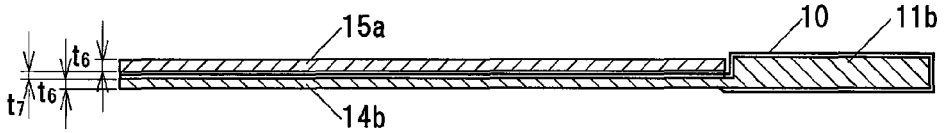
FIG. 3E is a cross-sectional view taken along the line D-D in FIG. 3A.
Figure 3F:
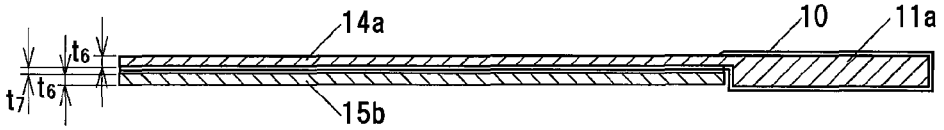
FIG. 3F is a cross-sectional view taken along the line E-E in FIG. 3A.

FIG. 3A is an overall perspective view schematically showing a laminated coil 100 having a configuration that a first coil part 10A that has a configuration that an insulating layer 10 is formed on the first circular conductive plate 1A and a second coil part 10B that has a configuration that an insulating layer 10 is formed on the second circular conductive plate 1B are laminated in an axis direction, FIG. 3B is a cross-sectional view taken along the line A-A in FIG. 3A, FIG. 3C is a cross-sectional view taken along the line B-B in FIG. 3A, FIG. 3D is a cross-sectional view taken along the line C-C in FIG. 3A, FIG. 3E is a cross-sectional view taken along the line D-D in FIG. 3A, and FIG. 3F is a cross-sectional view taken along the line E-E in FIG. 3A. Further, in FIGS. 3A to 3F, a dimension in a thickness direction is expressed with exaggeration in comparison with a dimension in a radial direction for convenience of explanation.

As shown in FIGS. 3B to 3F, the insulating layer 10 is formed on the first circular arc part 11*a*, the second circular arc part 12*a*, and the connection part 13*a* of the first circular conductive plate 1A, and the first circular arc part 11*b*, the second circular arc part 12*b*, and the connection part 13*b* of the second circular conductive plate 1B, so as to cover the surfaces of the parts. In addition, as shown in FIGS. 3E and 3F, the insulating layer 10 is also formed on surfaces of the first terminal strip 14*a* and the second terminal strip 15*b* that face each other, and surfaces of the first terminal strip 14*b* and the second terminal strip 15*a* that face each other. The insulating layer 10 is one example of the insulating material in the invention, and for example, includes an insulating resin such as polyimide having a thickness of 0.01 to 0.1 mm. In the embodiment, the insulating layer 10 is formed so as to have a thickness of 0.1 mm.

As shown in FIG. 3B, a thickness (t1) (dimension in an axis direction) of the connection parts 13*a*, 13*b* is set to 0.4 mm respectively. Since two layers of the insulating layer 10 are interposed between the connection parts 13*a*, 13*b*, the connection part 13*a* and the connection part 13*b* face each other via a thickness (t2=0.2 mm) of the two layers of the insulating layer 10. A thickness (t3) of the laminated coil 100 in the connection parts 13*a*, 13*b* is 1.2 mm, the thickness (t3) including the thickness of the insulating layer 10.

In addition, as shown in FIGS. 3C and 3D, a thickness (t4) of the first circular arc parts 11*a*, 11*b*, and the second circular arc parts 12*a*, 12*b* is set to 1.0 mm respectively. Consequently, a thickness (t5) of the laminated coil 100 in the first and second circular arc parts 11*a*, 11*b*, 12*a* and 12*b* is 1.2 mm, the thickness (t5) including the thickness of the insulating layer 10.

In addition, as shown in FIGS. 3E and 3F, a thickness (t6) of the first terminal strips 14*a*, 14*b*, and the second terminal strips 15*a*, 15*b* is set to 0.4 mm respectively. Since two layers of the insulating layer 10 are interposed between the first terminal strip 14*a* and the second terminal strip 15*b*, and between the first terminal strip 14*b* and the second terminal strip 15*a*, the first terminal strip 14*a* and the second terminal strip 15*b*, and the first terminal strip 14*b* and the second terminal strip 15*a* face each other respectively via a thickness (t7=0.2 mm) of the two layers of the insulating layer 10.

Manufacturing Method of Laminated Coil 100

Hereinafter, one example of a manufacturing method of laminated coil 100 will be explained.

The manufacturing method of the laminated coil 100 includes a press forming process in which the circular conductive plate 1 is pressed into shapes, an insulating layer forming process in which the insulating layer 10 is formed on the circular conductive plate 1, and a laminating process in which the first and second coil parts 10A, 10B that are a pair of the circular conductive plates 1 on which the insulating layer 10 is formed are laminated with each other so as to obtain the laminated coil 100.

In the press forming process, a conductive metal having a band-like shape is prepared, and the conductive metal of a band-like shape is pressed into shapes so as to obtain a plurality of the circular conductive plates 1.

Figure 4:
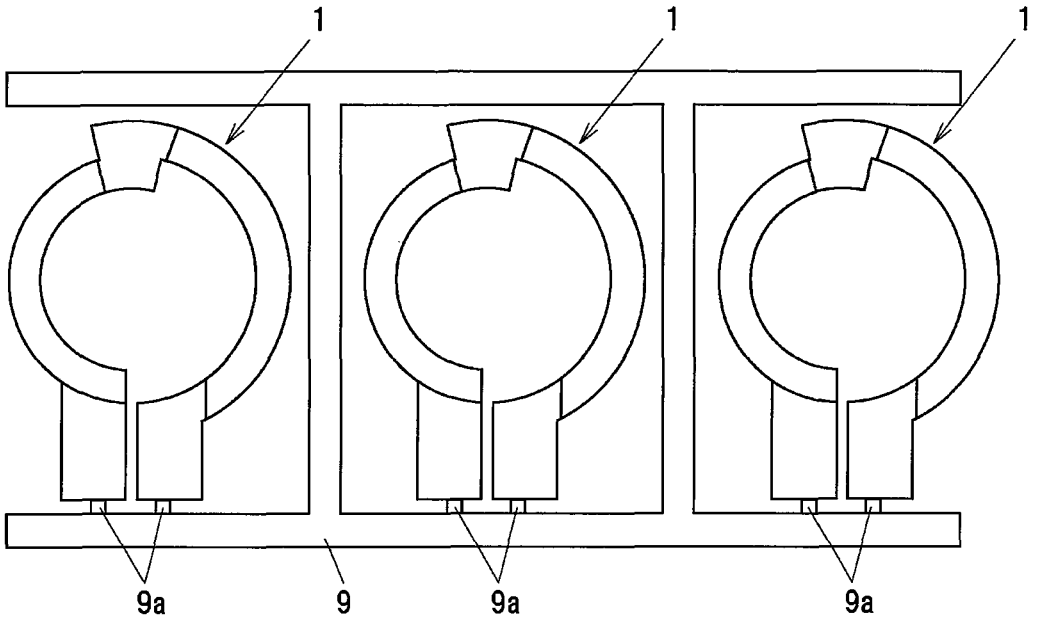
FIG. 4 is a plan view schematically showing an example of a state that a plurality of circular conductive plates obtained by press forming of a conductive metal having a band-like shape are supported by supporting members via supporting parts.

FIG. 4 is a plan view schematically showing an example of a state that a plurality of circular conductive plates 1 obtained by a press forming of a conductive metal having a band-like shape are supported by supporting members 9 via supporting parts 9*a*. In the example shown in FIG. 4, a plurality of the circular conductive plates 1 are pressed into shapes in a lump, after that, the supporting parts 9*a* are cut off by an industrial tool or the like so as to separate the circular conductive plates 1 from the supporting members 9. Further, in case that electrical resistance of a thinned part (connection part 13) is increased by processing strain of the conductive metal material due to a press processing, heat treatment is carried out after the press processing so as to release the processing strain, thereby resistivity can be brought close to a state before the press processing.

In the insulating layer forming process, a part (one side surface of the first and second terminal strips 14, 15) on which the insulating layer 10 is not to be formed is masked, and is coated with a liquid insulating resin, after that, the resin is hardened. Due to this, the first and second coil parts 10A, 10B can be obtained.

In the laminating process, the first and second coil parts 10A, 10B are laminated such that the obverse side and the reverse side of any one of the first and second coil parts 10A, 10B obtained in the insulating layer forming process are inverted, and side surfaces (end faces in an axis direction) of the connection parts 13*a*, 13*b* in which depression is formed face each other, so as to obtain the laminated coil 100. The first and second coil parts 10A, 10B laminated can be integrated by, for example, a resin mold process.

Use Application and Use Configuration of Laminated Coil 100

The laminated coil 100 can be used for noise elimination in a digital circuit, smoothing of power-supply voltage having ripples, constitutional elements of a low-pass filter or the like.

In addition, the laminated coil 100 can be used for a coil having one turn in which the first and second coil parts 10A, 10B are connected in parallel, if the first terminal strip 14*b* and the second terminal strip 15*a*, and the first terminal strip 14*a* and the second terminal strip 15*b* are shorted.

Alternatively, the laminated coil 100 can be used for a coil having two turns in which the first and second coil parts 10A, 10B are connected in series. In this case, for example, the first terminal strip 14*a* of the first and second coil part 10A and the first terminal strip 14*b* of the second coil part 10B are shorted, the second terminal strip 15*a* of the first and second coil part 10A is used as an input terminal, and the second terminal strip 15*b* of the second coil part 10B is used as an output terminal, thereby the laminated coil 100 can be used for a coil having two turns.

If the first and second coil parts 10A, 10B are connected in parallel, larger electrical current is allowed to flow than a case that the first and second coil parts 10A, 10B are connected in series. In addition, if the first and second coil parts 10A, 10B are connected in series, higher inductance can be obtained than a case that the first and second coil parts 10A, 10B are connected in parallel.

Figure 5:
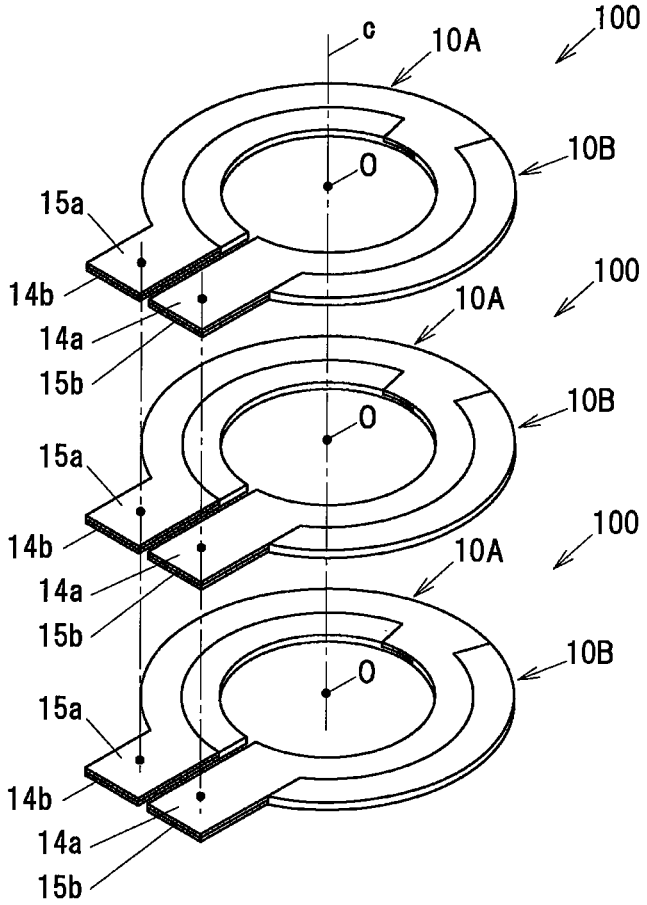
FIG. 5 is an explanatory perspective view schematically showing an example of connection in case that three laminated coils are interconnected in parallel with each other.

In addition, in case that even larger current capacity is needed, as shown in FIG. 5, a plurality of the laminated coils 100 that are connected in parallel can be used. FIG. 5 shows a connection example in a case that three laminated coils 100 are connected in parallel. In the connection example, the respective first terminal strips 14*b* and the respective second terminal strips 15*a* of the three laminated coils 100 are shorted, and the respective first terminal strips 14*a* and the respective second terminal strips 15*b* of the three laminated coils 100 are shorted. This makes it possible for electrical current to flow three times as much as a case that one laminated coil is used.

In addition, a plurality of the laminated coils 100 (in which the first and second coil parts 10A, 10B are connected in parallel) may be connected in series, thereby increasing current capacity and inductance simultaneously.

Figure 6:
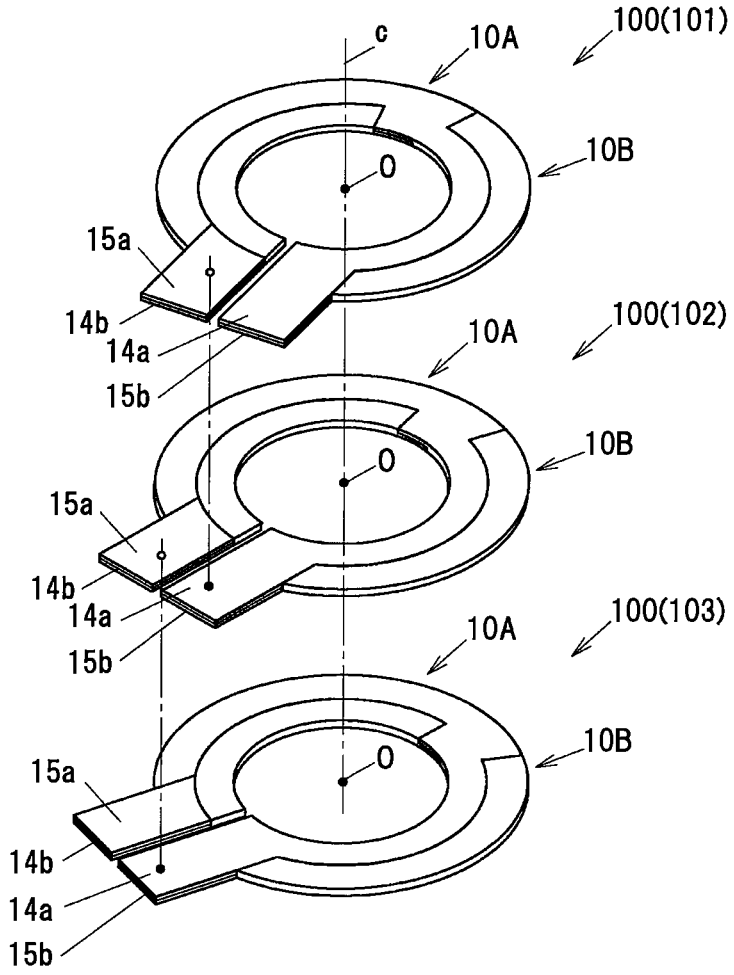
FIG. 6 is an explanatory perspective view schematically showing an example of connection in case that three laminated coils are interconnected in series with each other.

In the connection example shown in FIG. 6, three laminated coils 100 are connected in series. These three laminated coils 100 are identical to each other, but for convenience of explanation, are referred to as a first laminated coil 101, a second laminated coil 102 and a third laminated coil 103.

The first to third laminated coils 101 to 103 have a configuration that the respective first terminal strips 14*b* and the respective second terminal strips 15*a* are shorted, and the respective first terminal strips 14*a* and the respective second terminal strips 15*b* are shorted, and the first and second coil parts 10A, 10B are connected in parallel. In addition, the first terminal strip 14*b* and the second terminal strip 15*a* of the first laminated coil 101, and the first terminal strip 14*a* and the second terminal strip 15*b* of the second laminated coil 102 are connected to each other. Furthermore, the first terminal strip 14*b* and the second terminal strip 15*a* of the second laminated coil 102, and the first terminal strip 14*a* and the second terminal strip 15*b* of the third laminated coil 103 are connected to each other.

With regard to the connection of the first terminal strips 14*a*, 14*b* and the second terminal strip 15*a*, 15*b* of the first to third laminated coils 101 to 103, for example, the first to third laminated coils 101 to 103 are arranged with appropriate shift of phase centered on the central axis line (c), thereby they can be arranged in an axis direction in contact with each other without leaving a space in an axis direction.

Function and Effect of the First Embodiment

According to the first embodiment explained above, the following function and effect can be obtained.

(1) Heat generated in the first circular arc part 11*a* of the first circular conductive plate 1A due to power distribution to the laminated coil 100 is dissipated from a side surface of the first circular arc part 11*a* via the insulating layer 10, and simultaneously is conducted to the second circular arc part 12*a* via the connection part 13*a* so as to be dissipated from the second circular arc part 12*a*. Similarly, heat generated in the first circular arc part 11*b* of the second circular conductive plate 1B is dissipated from a side surface of the first circular arc part 11*b* via the insulating layer 10, and simultaneously is conducted to the second circular arc part 12*b* via the connection part 13*b* so as to be dissipated from the second circular arc part 12*b*. In other words, the first circular arc parts 11*a*, 11*b* located interiorly in the juxtaposition in a radial direction are surrounded by the second circular arc parts 12*a*, 12*b* on the outer side of the parts 11*a*, 11*b*, thus they have a radiation property lower than the second circular arc parts 12*a*, 12*b*, but heat generated in the first circular arc parts 11*a*, 11*b* is conducted to the second circular arc parts 12*a*, 12*b* so as to be dissipated therefrom, thereby the first circular arc parts 11*a*, 11*b* can be prevented from being filled with heat. Hereby, radiation property of the laminated coil 100 can be enhanced.

(2) The first circular arc part 11*a* and the second circular arc part 12*b*, and the first circular arc part 11*b* and the second circular arc part 12*a* are juxtaposed to each other in a radial direction, thus thickness in the central axis line (c) direction of the laminated coil 100 can be reduced. In other words, in case that a pair of circular conductive members formed so as to have the same diameter over whole circumference are laminated in an axis direction, as a result, the obtained laminated coil has a thickness that is approximately two times as much as each of the circular conductive members, but in the embodiment, the laminated coil 100 is formed to have a configuration that the first circular arc part 11*a* and the second circular arc part 12*b*, and the first circular arc part 11*b* and the second circular arc part 12*a* are juxtaposed to each other in a radial direction, and do not overlapped with each other in an axis direction, thus the laminated coil 100 can be prevented from an increase in thickness caused by that the first coil part 10A and the second coil part 10B are laminated with each other.

(3) The connection parts 13*a*, 13*b* are formed to have a thickness thinner than the first circular arc parts 11*a*, 11*b* and the second circular arc parts 12*a*, 12*b*, thus the thickness of the laminated coil 100 can be decreased in the regions corresponding to the connection parts 13*a*, 13*b*. In other words, when the first coil part 10A (the first first circular conductive plate 1A) and the second coil part 10B (the second second circular conductive plate 1B) are laminated, the connection part 13*a* and the connection part 13*b* are overlapped with each other in an axis direction, thus if the connection parts 13*a*, 13*b* have almost the same thickness as the first circular arc parts 11*a*, 11*b* and the second circular arc parts 12*a*, 12*b*, the connection parts 13*a*, 13*b* project in an axis direction, so that the thickness of the laminated coil 100 is increased in the projected part, but in the embodiment, the thickness (t1) of the connection parts 13*a*, 13*b* is approximately half the thickness (t4) of the first circular arc parts 11*a*, 11*b* and the second circular arc parts 12*a*, 12*b* ((t1/t4)=0.4), so that the laminated coil 100 can be prevented from an increase in thickness. Further, it is preferable that (t1/t4) is not less than 0.3 and not more than 0.5.

As described above, the connection parts 13*a*, 13*b* have half the thickness of the first circular arc parts 11*a*, 11*b* and the second circular arc parts 12*a*, 12*b*, but the connection parts 13*a*, 13*b* have approximately twice the width in a radial direction of the first circular arc parts 11*a*, 11*b* and the second circular arc parts 12*a*, 12*b*, thus difference in electrical resistance between the connection parts 13*a*, 13*b*, and the first circular arc parts 11*a*, 11*b* and the second circular arc parts 12*a*, 12*b* can be prevented. This makes it possible to prevent the connection parts 13*a*, 13*b* from locally generating heat, and to prevent the laminated coil 100 from being limited in electrical capacity due to the heat generation of the connection parts 13*a*, 13*b*. In the embodiment, the thickness (t1) of the connection parts 13*a*, 13*b* is not more than half the thickness (t4) of the first circular arc parts 11*a*, 11*b* and the second circular arc parts 12*a*, 12*b* ((t1/t4)=0.4), while the width in a radial direction (r22−r11=10.5 mm) of the connection parts 13*a*, 13*b* is not less than twice the width in a radial direction (r12−r11=5 mm) of the first circular arc parts 11*a*, 11*b*, and is not less than twice the width in a radial direction (r22−r21=5 mm) of the second circular arc parts 12*a*, 12*b*.

(5) The first coil part 10A (the first circular conductive plate 1A) and the second coil part 10B (the second circular conductive plate 1B) have the same shape with each other, thus the kind of parts can be reduced. In other words, before the first coil part 10A and the second coil part 10B are laminated with each other, it is not necessary to keep the first and second coil parts 10A, 10B as different parts, thus the manufacturing process can be simplified, so that production cost can be reduced.

Second Embodiment

Hereinafter, the second embodiment of the invention will be explained referring to FIG. 7 and FIG. 8.

Figure 7A:
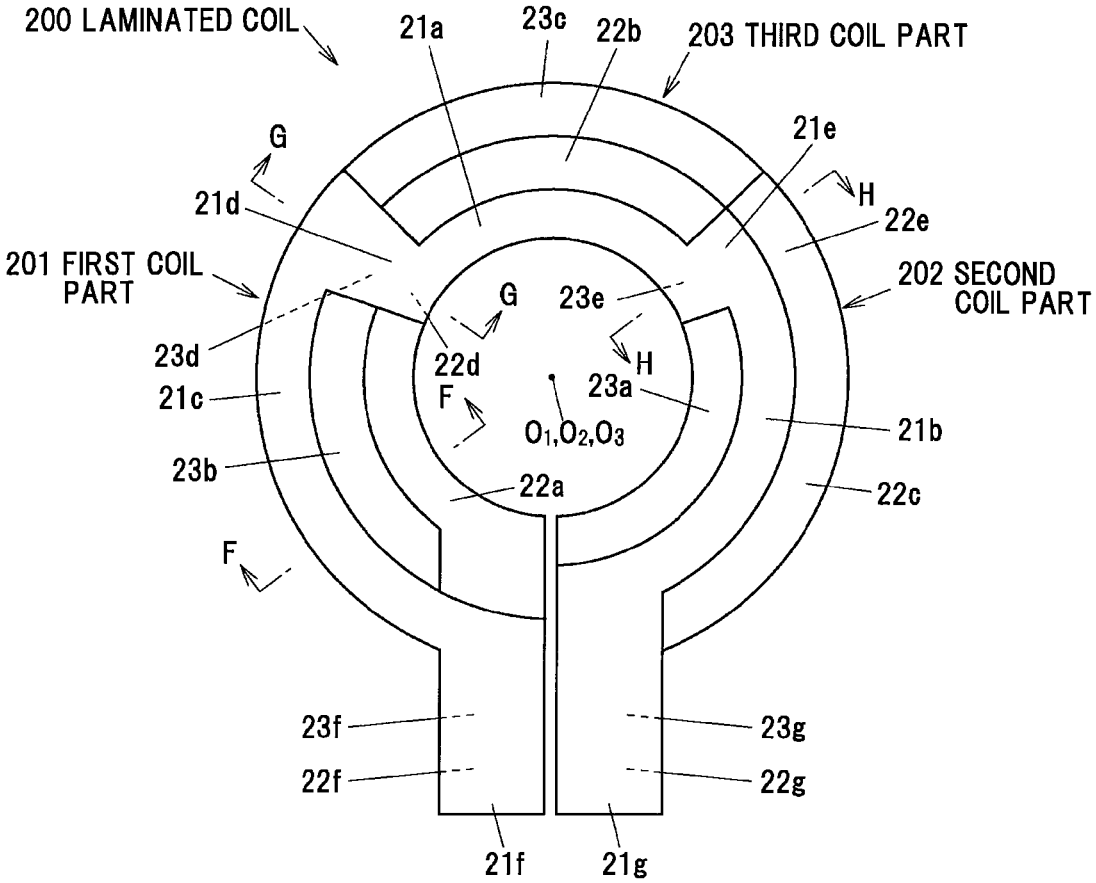
FIG. 7A is a front elevation view schematically showing a laminated coil according to another embodiment of the invention.
Figure 7B:
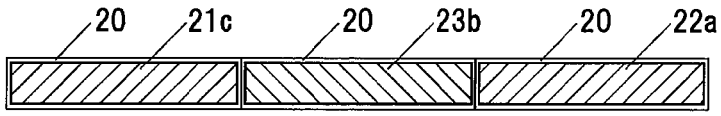
FIG. 7B is a cross-sectional view taken along the line F-F in FIG. 7A.
Figure 7C:
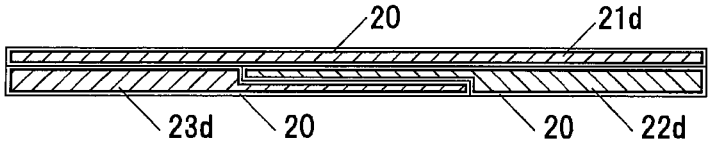
FIG. 7C is a cross-sectional view taken along the line G-G in FIG. 7A.
Figure 7D:
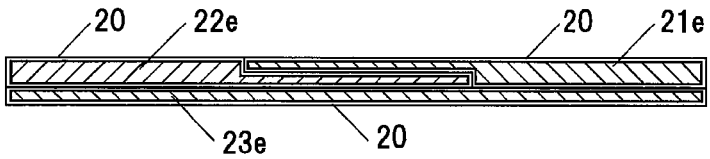
FIG. 7D is a cross-sectional view taken along the line H-H in FIG. 7A.

FIG. 7A is a front elevation view schematically showing a laminated coil 200 according to the second embodiment of the invention, FIG. 7B is a cross-sectional view taken along the line F-F in FIG. 7A, FIG. 7C is a cross-sectional view taken along the line G-G in FIG. 7A and FIG. 7D is a cross-sectional view taken along the line H-H in FIG. 7A. Further, in FIGS. 7B to 7D, a dimension in a thickness direction is expressed with exaggeration in comparison with a dimension in a radial direction for convenience of explanation.

The laminated coil 200 includes a first coil part 201, a second coil part 202 and a third coil part 203, and has a configuration that the first to third coil parts 201 to 203 are laminated with each other in an axis direction. The first to third coil parts 201 to 203 have a flat plate-like shape and have a configuration that an insulating layer 20 including an insulating resin such as polyimide is formed on the surfaces of first to third circular conductive plates 21 to 23 including a conductive metal respectively.

Figure 8A:
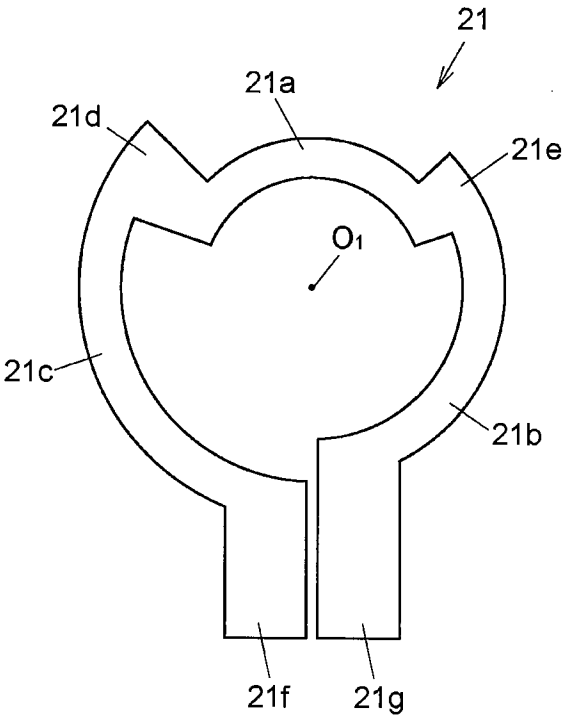
FIG. 8A is a front elevation view schematically showing a configuration of a first circular conductive plate.
Figure 8B:
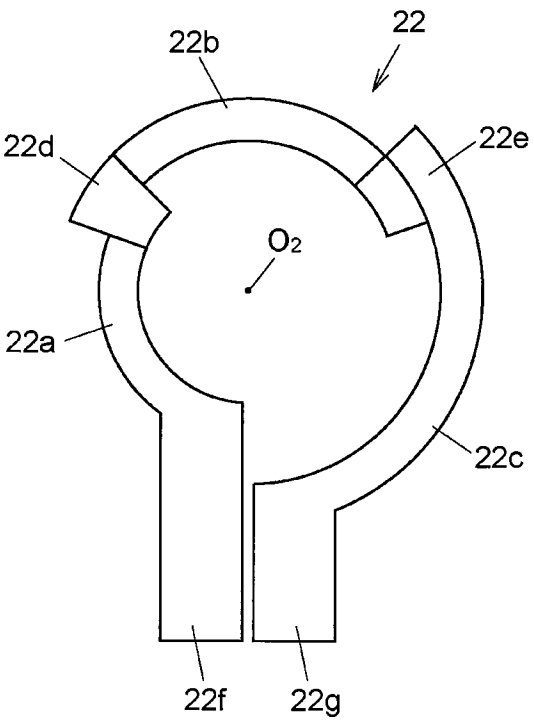
FIG. 8B is a front elevation view schematically showing a configuration of a second circular conductive plate.
Figure 8C:
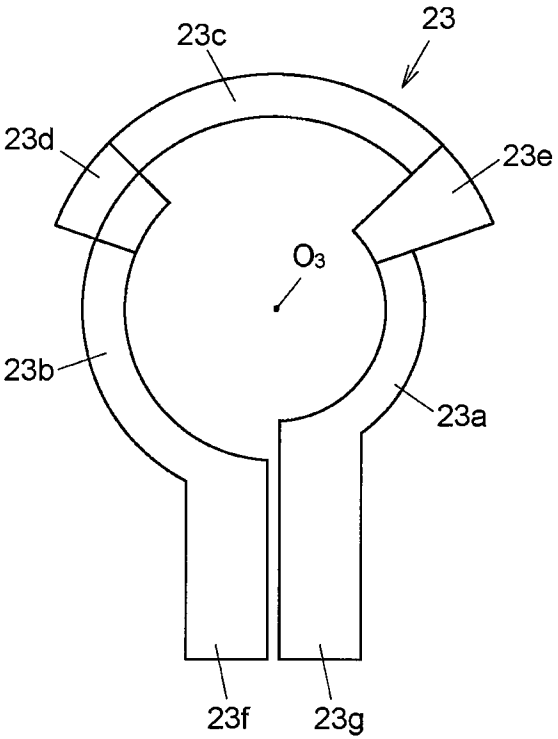
FIG. 8C is a front elevation view schematically showing a configuration of a third circular conductive plate.

FIGS. 8A, 8B and 8C are a front elevation view schematically showing a configuration of the first to third circular conductive plates 21 to 23 respectively.

Each of the first to third circular conductive plates 21 to 23 includes three circular arc parts that are different in an inner diameter and an outer diameter from each other, two connection parts that interconnect the three circular arc parts in a circumference direction, and two terminal strips that extend outward from both ends of the three circular arc parts interconnected in a radial direction.

As shown in FIG. 8A, the first circular conductive plate 21 includes a first circular arc part 21*a*, a second circular arc part 21*b* that has an inner diameter (inner radius) larger than an outer diameter (outer radius) of the first circular arc part 21*a*, and a third circular arc part 21*c* that has an inner diameter (inner radius) larger than an outer diameter (outer radius) of the second circular arc part 21*b*. The third circular arc part 21*c* and the first circular arc part 21*a* are connected with each other in a circumference direction by a first connection part

21*d*. The first circular arc part 21*a* and the second circular arc part 21*b* are connected with each other in a circumference direction by a second connection part 21*e*.

The first to third circular arc parts 21*a* to 21*c* have a concentric shape sharing a center point ($O_1$) as a center, and are formed so as not to be overlapped with each other in a radial direction. A first terminal strip 21*f* is formed to have a rectangular shape that extends outward from one end of the third circular arc part 21*c* in a radial direction. A second terminal strip 21*g* is formed to have a rectangular shape that extends outward from one end of the second circular arc part 21*b* and parallel to the first terminal strip 21*f*.

The first circular conductive plate 21 has a configuration that the third circular arc part 21*c*, the first connection part 21*d*, the first circular arc part 21*a*, the second connection part 21*e*, the second circular arc part 21*b* and second terminal strip 21*g* are sequentially arranged in a clockwise rotation direction in FIG. 8A from the first terminal strip 21*f*. The first and second connection parts 21*d*, 21*e*, and the first and second terminal strips 21*f*, 21*g* are formed to have a thickness thinner than the first to third circular arc parts 21*a* to 21*c*.

As shown in FIG. 8B, the second circular conductive plate 22 includes a first circular arc part 22*a*, a second circular arc part 22*b* that has an inner diameter larger than an outer diameter of the first circular arc part 22*a*, and a third circular arc part 22*c* that has an inner diameter larger than an outer diameter of the second circular arc part 22*b*. The first circular arc part 22*a* and the third circular arc part 22*c* are connected with each other in a circumference direction by a first connection part 22*d*. The second circular arc part 22*b* and the third circular arc part 22*c* are connected with each other in a circumference direction by a second connection part 22*e*.

The first to third circular arc parts 22*a* to 22*c* have a concentric shape sharing a center point ($O_2$) as a center, and are formed so as not to be overlapped with each other in a radial direction. A first terminal strip 22*f* is formed to have a rectangular shape that extends outward from one end of the first circular arc part 22*a* in a radial direction. A second terminal strip 22*g* is formed to have a rectangular shape that extends outward from one end of the third circular arc part 22*c* and parallel to the first terminal strip 22*f*.

The second circular conductive plate 22 has a configuration that the first circular arc part 22*a*, the first connection part 22*d*, the second circular arc part 22*b*, the second connection part 22*e*, the third circular arc part 22*c* and the second terminal strip 22*g* are sequentially arranged in a clockwise rotation direction in FIG. 8B from the first terminal strip 22*f*. The first and second connection parts 22*d*, 22*e*, and the first and second terminal strips 22*f*, 22*g* are formed to have a thickness thinner than the first to third circular arc parts 22*a* to 22*c*.

As shown in FIG. 8C, the third circular conductive plate 23 includes a first circular arc part 23*a*, a second circular arc part 23*b* that has an inner diameter larger than an outer diameter of the first circular arc part 23*a*, and a third circular arc part 23*c* that has an inner diameter larger than an outer diameter of the second circular arc part 23*b*. The second circular arc part 23*b* and the third circular arc part 23*c* are connected with each other in a circumference direction by a first connection part 23*d*. The third circular arc part 23*c* and the first circular arc part 23*a* and the are connected with each other in a circumference direction by a second connection part 23*e*.

The first to third circular arc parts 23*a* to 23*c* have a concentric shape sharing a center point ($O_3$) as a center, and are formed so as not to be overlapped with each other in a radial direction. A first terminal strip 23*f* is formed to have a rectangular shape that extends outward from one end of the second circular arc part 23*b* in a radial direction. A second terminal strip 23*g* is formed to have a rectangular shape that extends outward from one end of the first circular arc part 23*a* and parallel to the first terminal strip 23*f*.

The third circular conductive plate 23 has a configuration that the second circular arc part 23*b*, the first connection part 23*d*, the third circular arc part 23*c*, the second connection part 23*e*, the first circular arc part 23*a* and the second terminal strip 23*g* are sequentially arranged in a clockwise rotation direction in FIG. 8C from the first terminal strip 23*f*. The first and second connection parts 23*d*, 23*e*, and the first and second terminal strips 23*f*, 23*g* are formed to have a thickness thinner than the first to third circular arc parts 23*a* to 23*c*.

The first circular arc parts 21*a*, 22*a*, 23*a* are set so as to have the same inner diameter and outer diameter with each other. In addition, the second circular arc parts 21*b*, 22*b*, 23*b* are set so as to have the same inner diameter and outer diameter with each other. Also, the third circular arc parts 21*c*, 22*c*, 23*c* are set so as to have the same inner diameter and outer diameter with each other.

As shown in FIG. 7A, the first to third coil parts 201 to 203 are laminated in an axis direction such that the center points ($O_1$), ($O_2$), ($O_3$) are overlapped with each other. In addition, as shown in FIG. 7B, in regions between the first terminal strips 21*f*, 22*f*, 23*f* and the first connection parts 21*d*, 22*d*, 23*d*, the second circular arc part 23*b* is arranged on the outer side of the first circular arc part 22*a* in an radial direction, and the third circular arc part 21*c* is arranged on the outer side of the second circular arc part 23*b* in an radial direction.

In addition, in regions between the first connection parts 21*d*, 22*d*, 23*d* and the second connection parts 21*e*, 22*e*, 23*e*, the second circular arc part 22*b* is arranged on the outer side of the first circular arc part 21*a* in an radial direction, and the third circular arc part 23*c* is arranged on the outer side of the second circular arc part 22*b* in a radial direction. Furthermore, in regions between the second connection parts 21*e*, 22*e*, 23*e* and the second terminal strips 21*g*, 22*g*, 23*g*, the second circular arc part 21*b* is arranged on the outer side of the first circular arc part 23*a* in an radial direction, and the third circular arc part 22*c* is arranged on the outer side of the second circular arc part 21*b* in an radial direction.

As shown in FIG. 7C, with regard to the first connection parts 21*d*, 22*d*, 23*d*, the first connection part 21*d* of the first circular conductive plate 21, the second connection part 22*d* of the second circular conductive plate 22 and the first connection part 23*d* of the third circular conductive plate 23 are overlapped with each other in an axis direction in a region located at a central part in a radial direction of the laminated coil 200, and in a region located more interiorly than the above-mentioned region, the first connection part 21*d* and the first connection part 22*d* are overlapped with each other in an axis direction, and also in a region located more exteriorly than the above-mentioned region, the first connection part 21*d* and the first connection part 23*d* are overlapped with each other in an axis direction.

In addition, as shown in FIG. 7D, with regard to the second connection parts 21*e*, 22*e*, 23*e*, the first connection part 21*e* of the first circular conductive plate 21, the second connection part 22*e* of the second circular conductive plate 22 and the first connection part 23*e* of the third circular conductive plate 23 are overlapped with each other in an axis direction in a region located at a central part in a radial direction of the laminated coil 200, and in a region located more interiorly than the above-mentioned region, the first connection part 21*e* and the first connection part 23*e* are overlapped with each other in an axis direction, and also in a region located more exteriorly than the above-mentioned region, the first connection part 22*e* and the first connection part 23*e* are overlapped with each other in an axis direction.

Use Application and Use Configuration of Laminated Coil 200

Similarly to the laminated coil 100, the laminated coil 200 can be used for noise elimination in a digital circuit, smoothing of power-supply voltage having ripples, constitutional elements of a low-pass filter or the like.

In addition, the laminated coil 200 can be used for a coil having one turn in which the first to third coil parts 201 to 203 are connected in parallel, if the first terminal strips 21*f*, 22*f*, 23*f* are shorted with each other, and the second terminal strips 21*g*, 22*g*, 23*g* are shorted with each other.

Alternatively, the second terminal strip 21*g* and the first terminal strip 22*f*, and the second terminal strip 22*g* and the first terminal strip 23*f* are shorted respectively, the first terminal strip 21*f* is used as an input terminal, and the second terminal strip 23*g* is used as an output terminal, thereby the laminated coil 200 can be used for a coil having three turns.

If the first to third coil parts 201 to 203 are connected in parallel, larger electrical current is allowed to flow than a case that the first to third coil parts 201 to 203 are connected in series. In addition, if the first to third coil parts 201 to 203 are connected in series, higher inductance can be obtained than a case that the first to third coil parts 201 to 203 are connected in parallel.

Function and Effect of the Second Embodiment

According to the second embodiment explained above, the same function and effect as those of the first embodiment can be obtained. In addition, if the first to third coil parts 201 to 203 are connected in series, a coil having three turns can be obtained, so that higher inductance can be obtained in comparison with the laminated coil 100 according to the first embodiment.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

In particular, each of the above-mentioned embodiments shows a configuration that the circular conductive plates are insulated from each other by that the insulating layer 10, 20 are formed on the surface of the circular conductive plate, but the invention is not limited to this, a configuration that the circular conductive plates are insulated from each other by that spacers formed of an insulating material such as resin are arranged at a plurality of sites in a circumference direction can be also adopted.

In addition, each of the above-mentioned embodiments explains a configuration that the circular conductive plate is formed so as to have a circular shape, but the circular conductive plate can be also formed so as to have an elliptical shape.

In addition, each of the above-mentioned embodiments explains a configuration that the circular conductive plate has the first and second terminal strips, but the first and second terminal strips are not always necessary.

Alignment sequence of the first circular arc part, the second circular arc part and the third circular arc part in a circumference direction is not limited to that shown in each of the above-mentioned embodiments, but can be appropriately selected.

In addition, each of the above-mentioned embodiments explains a configuration that the laminated coils 100, 200 have two or three coil parts, but a laminated coil having a configuration that not less than four coil parts are laminated with each other can be also adopted.

Furthermore, each of the above-mentioned embodiments explains a configuration that the first and second circular arc parts, or the first to third circular arc parts are formed to have the same width in a radial direction with each other, but the invention is not limited to this, a configuration that the first and second circular arc parts, or the first to third circular arc parts are formed such that the more exteriorly the circular arc part is located, the wider width in a radial direction the circular arc part has can be also adopted. As a result, electrical resistance (direct-current component) of each of the circular arc parts can be equalized.

What is claimed is:

1. A laminated coil, comprising:

a plurality of annular electrically conductive plates in the form of a flat plate, the plurality of annular electrically conductive plates comprising a first annular electrically conductive plate and a second annular electrically conductive plate; and an electrical insulation with which the plurality of annular electrically conductive plates are laminated on top of each other in a central axis direction, wherein each of the plurality of annular electrically conductive plates respectively comprises:

at least two concentric circular arc parts comprising first and second circular arc parts that differ from each other in inner radius and outer radius, and an interconnection part which interconnects the at least two concentric circular arc parts, wherein the plurality of annular electrically conductive plates are arranged such that respective interconnection parts thereof are arranged on top of each other in the central axis direction and the respective at least two concentric circular arc parts of one annular electrically conductive plate are arranged to be radially coplanar with respective at least two concentric circular arc parts of another annular electrically conductive plate such that the first circular arc part of the first annular electrically conductive plate and the second circular arc part of the second annular electrically conductive plate are juxtaposed to each other in a radial direction, wherein the first circular arc part of the first annular electrically conductive plate does not overlap the second circular arc part of the second annular electrically conductive plate in an axial direction, and wherein the first circular arc part of the second annular electrically conductive plate and the second circular arc part of the first annular electrically conductive plate are juxtaposed to each other in the radial direction such that the first circular arc part of the second annular electrically conductive plate does not overlap the second circular arc part of the first annular electrically conductive in the axial direction.

2. The laminated coil according to claim 1, wherein the respective interconnection parts have a thickness less than a thickness of each of the respective at least two concentric circular arc parts.

3. A laminated coil, wherein a plurality of annular electrically conductive plates comprises a first annular electrically conductive plate and a second annular electrically conductive plate, wherein each of the first annular electrically conductive plate and the second annular electrically conductive plate comprises:

a first circular arc part, a second circular arc part that is formed concentric with the first circular arc part and that has an inner diameter exceeding an outer diameter of the first circular arc part, and an interconnection part that interconnects the respective first and second circular arc parts, wherein the second circular arc part of the second annular electrically conductive plate is arranged on a radial outer side of the first circular arc part of the first annular electrically conductive plate, wherein the second circular arc part of the first annular electrically conductive plate is arranged on a radial outer side of the first circular arc part of the second annular electrically conductive plate, wherein the first circular arc part of the first annular electrically conductive plate and the second circular arc part of the second annular electrically conductive plate are juxtaposed to each other in a radial direction such that the first circular arc part of the first annular electrically conductive plate does not overlap the second circular arc part of the second annular electrically conductive plate in an axial direction, and wherein the first circular arc part of the second annular electrically conductive plate and the second circular arc part of the first annular electrically conductive plate are juxtaposed to each other in the radial direction such that the first circular arc part of the second annular electrically conductive plate does not overlap the second circular arc part of the first annular electrically conductive plate in the axial direction.

4. The laminated coil according to claim 3, wherein the first annular electrically conductive plate and the second annular electrically conductive plate have a same shape, and are laminated such that an obverse side and a reverse side of one of the annular electrically conductive plates are inverted.

5. The laminated coil according to claim 1, wherein the second circular arc part is formed concentric with the first circular arc part, and has an inner diameter exceeding an outer diameter of the first circular arc part, wherein the plurality of annular electrically conductive plates further comprises a third annular electrically conductive plate, wherein the third annular electrically conductive plate comprises:

a first circular arc part, and a second circular arc part that is formed concentric with the first circular arc part and that has an inner diameter exceeding an outer diameter of the first circular arc part, wherein the first, second and third annular electrically conductive plates each further comprises:

a third circular arc part that is formed concentric with the first and second circular arc parts, a first interconnection part, and a second interconnection part, and wherein the first, second and third annular electrically conductive plates are laminated such that the respective second and third circular arc parts of two of the plurality of annular electrically conductive plates are arranged on a radial outer side of the first circular arc part of one of the plurality of annular electrically conductive plates.

6. The laminated coil according to claim 5, wherein two of the first, second and third annular electrically conductive plates have a same shape, and the two annular electrically conductive plates are laminated such that an obverse side and a reverse side of one of the two annular electrically conductive plates are inverted.

7. The laminated coil according to claim 3, wherein the respective interconnection parts have a thickness that is less than a thickness of the respective first circular arc part and less than a thickness of the respective second circular arc part.

8. The laminated coil according to claim 1, wherein the respective annular electrically conductive plates include respective terminal strips that have a rectangular shape and that extend parallel to each other.

* * * * *